US006855036B1

(12) United States Patent
Arserio et al.

(10) Patent No.: US 6,855,036 B1
(45) Date of Patent: Feb. 15, 2005

(54) PART-HOLDING FIXTURE FOR GRINDING WEDGED OPTICAL FLATS

(75) Inventors: Gregory J. Arserio, Macedon, NY (US); Thomas E. Manno, Rochester, NY (US); Robert E. Heath, Canandaigua, NY (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 10/634,588

(22) Filed: Aug. 5, 2003

(51) Int. Cl.[7] ..... B24B 1/00; B24B 13/005
(52) U.S. Cl. ..... 451/42; 451/240; 451/390
(58) Field of Search ..... 451/42, 364, 384, 451/390, 246, 255, 256, 259, 277; 269/21, 909, 309; 279/3

(56) References Cited

U.S. PATENT DOCUMENTS 2,394,645 A * 2/1946 Turner et al. ..... 451/41
2,444,531 A * 7/1948 Richardson ..... 451/388
2,688,220 A * 9/1954 Boutell ..... 451/388
4,172,338 A * 10/1979 Kojo et al. ..... 451/227
4,575,969 A * 3/1986 Klingel et al. ..... 451/285
5,005,633 A * 4/1991 Mathews et al. ..... 164/334
5,119,595 A * 6/1992 Ushiyama et al. ..... 204/212
5,150,547 A * 9/1992 Johnson ..... 451/390
5,220,749 A * 6/1993 Youden et al. ..... 451/65
5,291,692 A * 3/1994 Takahashi et al. ..... 451/388
6,224,467 B1 * 5/2001 Tanaka et al. ..... 451/42
6,383,061 B1 * 5/2002 Mandler ..... 451/43
6,634,933 B2 * 10/2003 Koshi et al. ..... 451/42

* cited by examiner

*Primary Examiner*—David B. Thomas
(74) *Attorney, Agent, or Firm*—Timoth M. Schaeberle

(57) ABSTRACT

A part-holding fixture is adapted for rotation about a work spindle axis and includes a mounting land that seals a back surface of an optical flat for securing the optical flat to the part-holding fixture and that inclines the back surface of the optical flat through a wedge angle for grinding wedged optical flats at repeatable wedge angles.

21 Claims, 4 Drawing Sheets

PART-HOLDING FIXTURE FOR GRINDING WEDGED OPTICAL FLATS

TECHNICAL FIELD

The invention relates to the fabrication of wedged optical flats (also referred to as wedged, piano optics) and is particularly concerned with part-holding fixtures for mounting such optics on optical grinding machines.

BACKGROUND

Wedged optical flats, which are useful for such purposes as windows for lasers, output couplers, and beam splitters, are typically fabricated to required tolerances for finish, flatness, and wedge angle on loose-abrasive lapping machines. One or more of the optical flats are mounted between relatively rotating finishing plates in the presence of a loose abrasive. One side of the plates is weighted to fashion the desired wedge angle. While single batches of optical flats can be finished to desired tolerances, the process is operator-dependent and generally unrepeatable.

SUMMARY OF INVENTION

The invention involves a part-holding fixture for mounting wedged optical flats on fixed-abrasive grinding machines, particularly CNC (computer numeric controlled) optical grinding machines. The part-holding fixture individually supports the optical flats onto a work spindle of the CNC grinding machine in a skewed manner, such that a bottom surface of the optical flats has a surface normal that is inclined to a rotational axis of the work spindle. As such, the optical flats wobble when rotated by the work spindle. A fixed abrasive finishes a top surface of the wobbling optical flats normal to the rotational axis of the work spindle. Upon such finishing, the top and bottom surfaces of the optical flats are inclined with respect to each other through a wedge angle set by the skew angle of the part-holding fixture. Successive optical flats can be ground to a matching wedge angle set by the part-holding fixture.

In addition to improved repeatability, the invention is also expected to provide decreased cycle times, easier setup, less operator dependency, decreased batch sizes, and increased process flexibility.

One example of our invention as a part-holding fixture for grinding wedged optical flats includes a fixture body having an axis of rotation. A first end of the fixture body is adapted for rotation by a machine work spindle. A second end of the fixture body is adapted for mounting an optical flat having top and bottom planar surfaces. An aperture formed through the first end of the fixture body communicates with a recess formed in the second end of the fixture body for drawing a vacuum through the fixture body. A mounting land formed in the second end of the fixture body surrounds the recess and has a closed shape for forming a vacuum seal against the bottom planar surface of the optical flat. A collar mounted on the fixture body surrounds the mounting land for centering the optical flat with respect to the rotational axis of the fixture body. The mounting land is oriented in a plane whose normal is inclined to the rotational axis of the fixture body for grinding the top planar surface at a wedge angle with respect to the bottom planar surface.

Preferably, the mounting land is a part of a curved surface in the second end of the fixture body for limiting contact between the mounting land and the bottom planar surface of the optical flat. The limited contact of the mounting land preferably traces an annular shape. In addition, at least the second end of the fixture body is made of a material that is softer than optical glass to avoid scratching the optical flat. The plane of the mounting land is preferably inclined to the rotational axis of the fixture body by at least ten minutes.

The collar is preferably shaped to engage both a periphery of the optical flat and a periphery of the fixture body. To save cost and to avoid interfering with the grinding process, the collar can be made from a soft material, such as resin. Even if the collar is struck by a fixed abrasive such as a grinding wheel, the collar is intended to have no significant effect on the grinding process.

Another example of our invention as a grinding system for machining optical flats with wedged planar surfaces includes a rotatable work spindle having a central vacuum draw. A rotatable tool spindle supports a grinding tool. A feed system relatively translates the rotatable work spindle and the rotatable tool spindle with respect to each other. A part-holding fixture has a first end adapted for rotation with the rotatable work spindle about a rotational axis and a second end adapted for supporting an optical flat having top and bottom planar surfaces. A central aperture formed through the part-holding fixture communicates with the central vacuum draw. A mounting land formed on the second end of the part-holding fixture surrounds the central aperture and has a closed shape for forming a vacuum seal against the bottom planar surface of the optical flat. The bottom planar surface of the optical flat has a planar surface normal that is inclined to the rotational axis of the part-holding fixture when engaged with the mounting land formed on the second end of the part-holding fixture.

A collar is preferably supported by the part-holding fixture in a position that surrounds the mounting land and engages a periphery of the optical flat for centering the optical flat with respect to the rotational axis of the part-holding fixture. The feed system preferably relatively translates the rotatable work spindle and the rotatable tool spindle with respect to each other in a direction along the rotational axis of the part-holding fixture. A recess formed in the second end of the part-holding fixture can be arranged for communication with the central aperture.

The mounting land preferably surrounds the recess for communicating a pressure reduction within the recess against the bottom planar surface of the optical flat. Preferably, the mounting land has an annular shape and is formed as a part of a curved surface on the second end of the part-holding fixture. For example, the mounting land can be formed as a part of a toroidal surface.

An example of the invention as a method of machining optical flats with wedged planar surfaces provides for mounting an optical flat having top and bottom surfaces on a first part-holding fixture, which rotates about a work spindle rotational axis. A grinding wheel, which rotates about a tool spindle rotational axis, is moved into engagement with the bottom surface of the optical flat. The bottom surface of an optical flat is thereby ground into a planar form having a planar surface normal that extends parallel to the work spindle rotational axis. The bottom planar surface of the optical flat is subsequently mounted on a second part-holding fixture in a position that orients the planar surface normal of the bottom planar surface at an inclination with respect to the work spindle rotational axis. The second part-holding fixture is rotated about the work spindle rotational axis. A grinding wheel rotates about the tool spindle rotational axis and moves into engagement with the top surface of the optical flat. The top surface of the optical flat is ground into a planar form having a planar surface normal that extends parallel to the work spindle rotational axis but is inclined with respect to the planar surface normal of the bottom planar surface.

Preferably, the work spindle rotates the grinding wheel about the tool spindle rotational axis parallel to the work spindle rotational axis. The planar surface normal of the bottom surface is preferably formed parallel to both the work spindle rotational axis and the tool spindle rotational axis. The planar surface normal of the top surface is also preferably formed parallel to both the work spindle rotational axis and the tool spindle rotational axis. The grinding wheel is preferably fed in a direction parallel to the rotational axis of the tool spindle for engaging the top and bottom surfaces of the optical flat.

A vacuum pressure reduction is preferably applied against the bottom planar surface for holding the optical flat against a part-holding fixture that is rotatable about the work spindle axis. The bottom planar surface is preferably engaged with a mounting land in an orientation that inclines the planar surface normal of the bottom planer surface with respect to the work spindle rotational axis.

DRAWINGS

DETAILED DESCRIPTION

Figure 1:
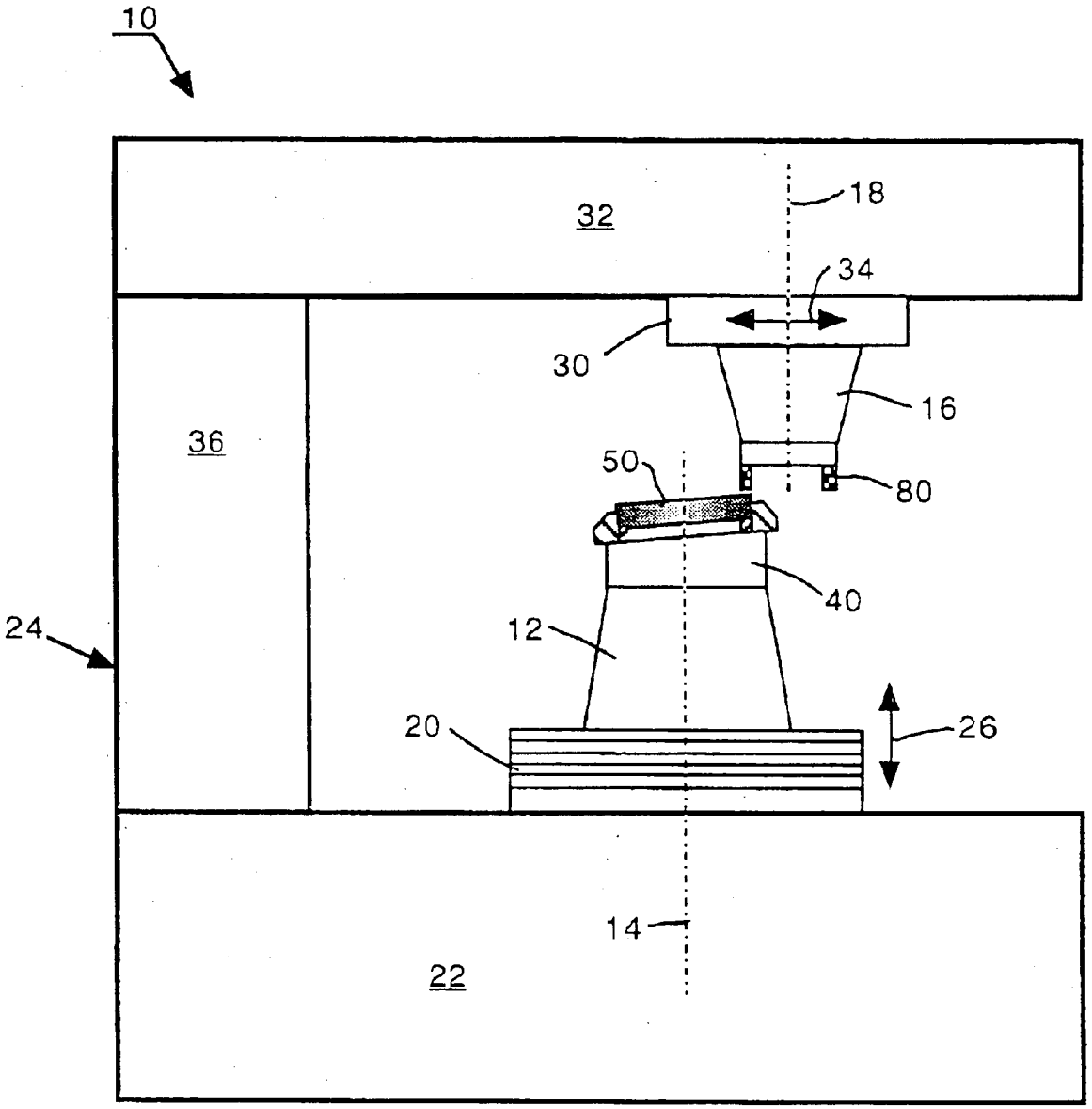
FIG. 1 is a diagram of an optical CNC grinder showing an inclined part-holding fixture rotatable about a work spindle axis that is parallel to a tool spindle axis of a grinding wheel.

An exemplary CNC optical grinder 10 adapted for purposes of the invention is depicted in FIG. 1 as having a work spindle 12 mounted for rotation about a work spindle axis 14 and a tool spindle 16 mounted for rotation about a tool spindle axis 18. A vertical stage 20 supports the work spindle 12 above a base 22 of a machine frame 24 for translation in the vertical direction of arrows 26. A horizontal stage 30 supports, the tool spindle 16 from an arm 32 of the machine frame 24 for translation in the horizontal direction of arrows 34. A pillar 36 connects the arm 32 to the base 22 of the machine frame 24.

Although it remains preferred for the work spindle 12 to be rotatable about a work spindle axis 14 and for the tool spindle 16 to be rotatable about a tool spindle axis 18, other combinations of translational or rotational axes can be used to provide desired relative motions between the work spindle 12 and the tool spindle 16. One or more such axes is preferably used as a setup axis and another of such axis is used as a feed axis. In the illustrated grinder 10, the horizontal stage 30 is preferably used as a setup axis in the direction of arrows 34, and the vertical stage 20 is preferably used as a feed axis in the direction of arrows 26.

An optical grinder adaptable to these purposes is a CNC Digital Grinder from Schneider such as the Schneider SLG 50. In addition to the axes shown, the Schneider machine has a tool spindle pivot axis that can be used to orient the tool spindle 18 parallel to the work spindle 14 for setup purposes.

Figure 2:
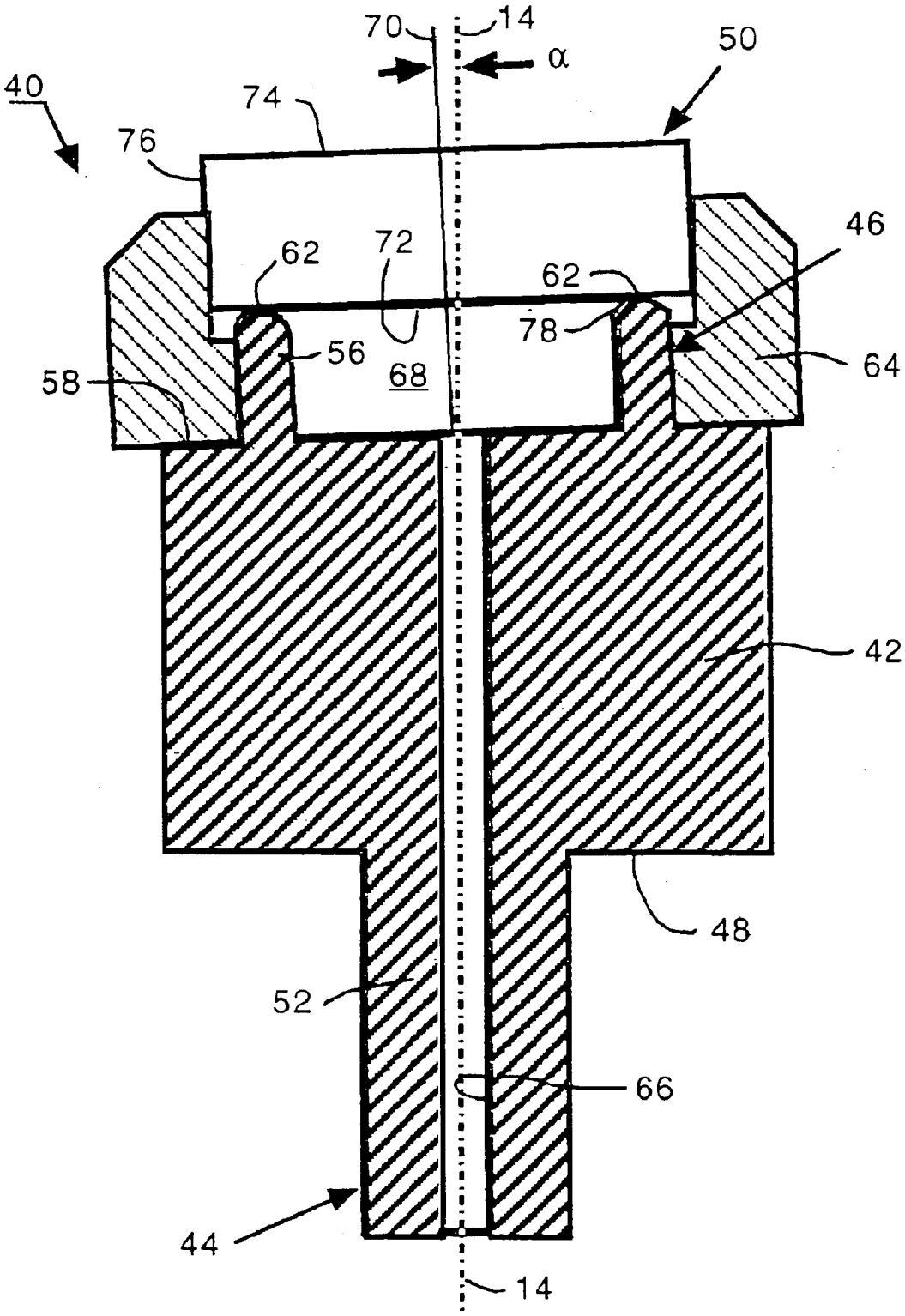
FIG. 2 is a sectional view of the part-holding fixture in an axial plane of rotation.
Figure 3:
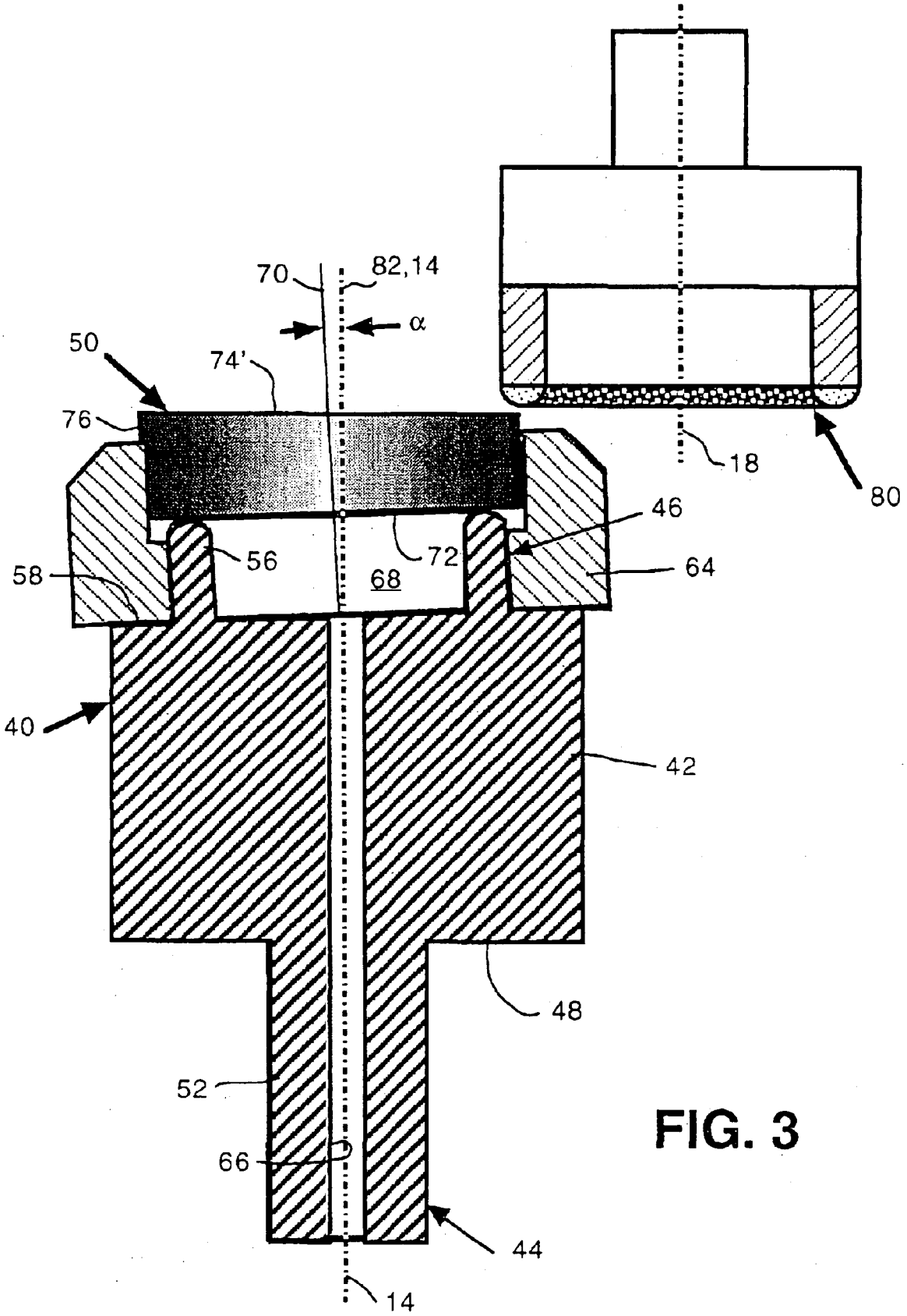
FIG. 3 is a sectional view of the part-holding fixture in relation to a grinding wheel for grinding the top surface of an optical flat at an inclination angle with respect to a bottom surface of the optical flat.

As better seen in FIGS. 2 and 3, a part-holding fixture 40 includes a fixture body 42 having a first end 44 that is adapted for rotation with the work spindle 12 and a second end 46 that is adapted for mounting an optical flat 50 in an operative position for grinding. The first end 44 includes a mounting flange 4B formed at a bottom of a fixture body 42 and a journal 52 formed about an extended portion of the fixture body 42. The second end 46 includes a mounting rim 56 that projects above an inclined mounting surface 58 of the fixture body 42. The optical flat 50 rests on a mounting land 62 of the mounting rim 56. A collar 64, which rests on the inclined mounting surface 58, surrounds the mounting land 62 for centering the optical flat 50 with respect to the work spindle axis 14.

An aperture 66 formed in the first end 44 of the fixture body 42 extends into communication with a recess 68 formed in the second end 46 of the fixture body 42 for drawing a vacuum into the fixture body 42. Ordinarily, work spindle vacuum draws are converted into mechanical clamping forces, such as changes in collet diameters. However, according to the invention, the mounting land 62 surrounds the recess and has a closed shape for forming a vacuum seal against a bottom surface 72 of the optical flat 50. A top surface 74 of the optical flat 50, which is subject to grinding (shown ground in FIG. 3 as 74'), is exposed to atmospheric pressure; and the differential pressure between the top surface 74 (74') and the bottom surface 72 holds the optical flat 50 against the mounting land 62. The collar 64 is shaped to engage a periphery 76 of the optical flat 50 to counteract any forces (e.g., centrifugal forces) acting in the plane of the mounting land 62. The contact between the collar 64 and the optical flat's periphery 76 is preferably continuous but could also be intermittent having at least three angularly spaced points of contact.

A curved surface 78 on the projected end of the mounting rim 56 limits contact between the mounting land 62 and the bottom surface 72 of the optical flat 50. A preferred radius of curvature for the curved surface 78 is around 100 centimeters. A chamfer or other irregular shape could also be used on the end of the mounting rim 56 to produce an approximate line contact between the optical flat 50 and the mounting rim 56. The limited (e.g., line) contact provides a more certain seal between the fixture body 42 and the optical flat 50. As illustrated, the mounting land 62 has an annular shape formed by an intersection of a planar form of the bottom surface 72 of the optical flat with a toroidal form of the curved surface 78 of the mounting rim 56. Other closed shapes can be formed for the mounting land 62 by modifying the shape of the mounting rim 56, such as shapes that follow the peripheral contours of alternative optical flats.

Both the mounting surface 58 and the mounting land 62 have a common planar surface normal 70 that is inclined with respect to the common rotational axis 14 of the part-holding fixture 40 and the work spindle 12 through angle "$\alpha$". Thus, both the optical flat 50, which rests on the mounting land 62, and the collar 64, which rests on the mounting surface 58, are similarly inclined so at to produce a wobble when first rotated about the axis 14. The size of the inclination angle "$\alpha$" is equal to the desired wedge angle of the optical flat 50.

The fixture body 42 and particularly the mounting land 62 are preferably formed of a material that is softer than the optical flat 50 to avoid scratching or otherwise damaging the optical flat 50. For example, the fixture body 42 can be made of brass, which is significantly softer than optical glass. The collar 64 is also made of a softer material, such as acetyl, to protect the optical flat 50. In addition, the collar material is chosen to avoid interfering with the grinding of the optical flat 50, if struck or traversed by a grinding wheel 80 (see FIG. 3) during the grinding process.

FIG. 3 shows the grinding wheel 80 oriented in relation to the part-holding fixture 40 for grinding the top surface 74' of the optical flat 50. The tool spindle 16 provides for mounting and rotating the grinding wheel 80 about the tool spindle axis 18, which extends parallel to the common rotational axis 14 of the part-holding fixture 40 and the work spindle 12. Rotational speeds of the grinding wheel 80 ranging from rough grinding at 15,000 RPM (revolutions per minute) to finish grinding at 30,000 RPM are typical.

The grinding wheel 80 is preferably a diamond ring tool (i.e., an annular shaped tool) formed by embedding diamonds in a resin or bronze matrix. Such grinding wheels are available from Schneider.

Figure 2A:
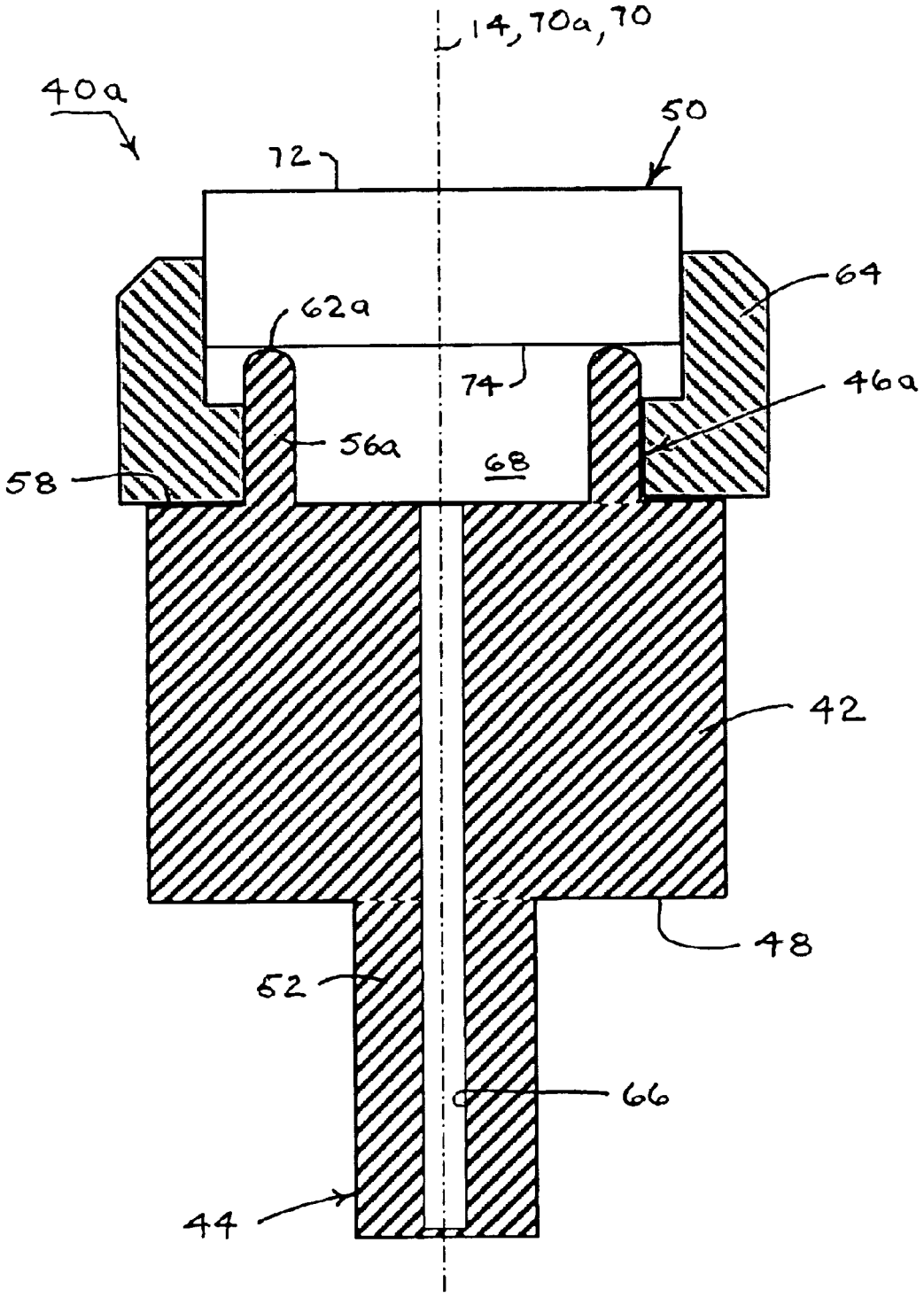
FIG. 2A is a sectional view of the part-holding fixture in an axial plane of rotation arranged for grinding a bottom surface of an optical flat.

Prior to grinding the top surface 74, the optical flat 50 is preferably mounted on an alternative part-holding fixture 40*a*, as shown in FIG. 2A, with its planar surface 72 aligned normal with the common rotational axis 14 of the alternative part-holding fixture 40*a* and the works spindle 12 for grinding the bottom surface 72. The part-holding fixture 40*a* is similar to the part-holding fixture 40 and the same reference numerals are used to designate the similar parts. However, the mounting lands 62*a* on the curved surface 78*a* of the mounting rim 56*a* lie in a plane having a normal 70*a* aligned with the common rotational axis 14 of the part-holding fixture 40*a*. Thus, the bottom surface 72 is ground to a planar form having a planar surface normal 70 that extends parallel to the common rotational axis 14 of the alternative part-holding fixture 40*a* and the work spindle 12.

The planar bottom surface 72 of the optical flat 50 is then mounted on the part-holding fixture 40 so that the same planar surface normal 70 is inclined through the angle "α" with respect to the common rotational axis 14 of the part-holding fixture 40 and the work spindle 12. A vacuum is drawn through the part-holding fixture 40 against the optical flat's bottom surface 72 within a region bounded by the mounting land 62 for securing the optical flat 50 to the part-holding fixture 20. The collar 64 centers the optical flat 50 on the part-holding fixture 40 with respect to the common rotational axis 14 of the part-holding fixture 40 and the work spindle 12. The part-holding fixture 40 together with the work spindle 12 is rotated around the rotational axis 14 for presenting the entire top surface 74, 74' of the optical flat 50 to the grinding wheel 80. Work spindle rotational speeds of 250 RPM are typical.

The top surface 74, 74' of the optical flat 50 is ground to a planar form having a planar surface normal 82 that extends parallel to the common rotational axis 14 but is inclined through angle "α" with respect to the planar surface normal 70 of the bottom surface 72 to form the optical flat 50 with a desired wedge angle (also angle "α"). The overall thickness of the ground optical flat 50 is controlled by translation of the work spindle 12 in the direction of arrows 26. If the grinding wheel 80 is of sufficient size to cover a radius of the top surface 74, 74' and the optical flat 50 is rotated about the common rotational axis 14, then once the grinding wheel 80 is appropriately positioned in the direction of arrows 30, translation of the part-holding fixture 40 in the direction of arrows 26 is the only feed motion required to grind the entire top surface 74, 74'. Other grinding wheel shapes and other motions between the grinding wheel 80 and the part-holding fixture 40, including rotational motions, can be used to sweep a plane normal to the common rotational axis 14 of the part-holding fixture 40 and the work spindle 12.

While the invention is particularly concerned with the manufacture of wedged optical flats to repeatable wedge angles, the peripheral shape of the wedged optical flats can be varied according to requirements of use. Wedge angles "α" of ten minutes or more are preferred for this invention. Subsequent operations such as polishing can be used to improve surface finish and flatness of the wedged optical flats.

We claim:

1. A part-holding fixture for grinding wedged optical flats comprising:

a fixture body having an axis of rotation;

a first end of the fixture body being adapted for rotation by a machine work spindle;

a second end of the fixture body being adapted for mounting an optical flat having top and bottom planar surfaces;

an aperture formed through the first end of the fixture body in communication with a recess formed in the second end of the fixture body for drawing a vacuum through the fixture body;

a mounting land formed in the second end of the fixture body surrounding the recess and having a closed shape for forming a vacuum seal against the bottom planar surface of the optical flat;

a collar mounted on the fixture body surrounding the mounting land for centering the optical flat with respect to the rotational axis of the fixture body; and the mounting land being oriented in a plane whose normal is inclined to the rotational axis of the fixture body for grinding the top planar surface at a wedge angle with respect to the bottom planar surface.

2. The part-holding fixture of claim 1 in which the mounting land is a part of a curved surface in the second end of the fixture body for limiting contact between the mounting land and the bottom planar surface of the optical flat.

3. The part-holding fixture of claim 1 in which the mounting land has an annular shape.

4. The part-holding fixture of claim 1 in which at least the second end of the fixture body is made of a material that is softer than optical glass to avoid scratching the optical flat.

5. The part-holding fixture of claim 1 in which the collar is shaped to engage both a periphery of the optical flat and a periphery of the fixture body.

6. The part-holding fixture of claim 5 in which the collar is made from a resin material.

7. A grinding system for machining optical flats with wedged planar surfaces comprising:

a rotatable work spindle having a central vacuum draw;

a rotatable tool spindle for supporting a grinding tool;

a feed system for relatively translating the rotatable work spindle and the rotatable tool spindle with respect to each other;

a part-holding fixture having a first end adapted for rotation with the rotatable work spindle about a rotational axis and a second end adapted for supporting an optical flat having top and bottom planar surfaces;

a central aperture formed through the part-holding fixture in communication with the central vacuum draw;

a mounting land formed on the second end of the part-holding fixture surrounding the central aperture and having a closed shape for forming a vacuum seal against the bottom planar surface of the optical flat; and the bottom planar surface of the optical flat having a planar surface normal that is inclined to the rotational axis of the part-holding fixture when engaged with the mounting land formed on the second end of the part-holding fixture.

8. The grinding system of claim 7 further comprising a collar supported by the part-holding fixture in a position that surrounds the mounting land and engages a periphery of the optical flat for centering the optical flat with respect to the rotational axis of the part-holding fixture.

9. The grinding system of claim 7 in which the feed system relatively translates the rotatable work spindle and the rotatable tool spindle with respect to each other in a direction along the rotational axis of the part-holding fixture.

10. The grinding system of claim 7 in which a recess is formed in the second end of the part-holding fixture in communication with the central aperture.

11. The grinding system of claim 10 in which the mounting land surrounds the recess for communicating a pressure reduction within the recess against the bottom planar surface of the optical flat.

12. The grinding system of claim 7 in which the mounting land has an annular shape.

13. The grinding system of claim 12 in which the mounting land is formed as a part of a curved surface on the second end of the part-holding fixture.

14. The grinding system of claim 13 in which the mounting land is formed as a part of a toroidal surface.

15. A method of machining optical flats with wedged planar surfaces comprising the steps of:

mounting an optical flat having top and bottom surfaces on a first part-holding fixture such that the top surface is in contact with a mounting land of the first part-holding fixture;

rotating the first part-holding fixture about a work spindle rotational axis;

rotating a grinding wheel into engagement with the bottom surface of the optical flat about a tool spindle rotational axis;

grinding the bottom surface of an optical flat into a planar form having a planar surface normal that extends parallel to the work spindle rotational axis;

mounting the bottom planar surface of the optical flat in contact with a mounting land of a second part-holding fixture in a position that orients the normal of the bottom planar surface at an inclination with respect to the work spindle rotational axis;

rotating the second part-holding fixture about the work spindle rotational axis;

rotating a grinding wheel into engagement with the top surface of the optical flat about the tool spindle rotational axis; and grinding the top surface of the optical flat into a planar form having a planar surface normal that extends parallel to the work spindle rotational axis, but is inclined with respect to the planar surface normal of the bottom planar surface.

16. The method of claim 15 in which the steps of rotating the grinding wheel include rotating the grinding wheel about the tool spindle rotational axis parallel to the work spindle rotational axis.

17. The method of claim 16 in which the step of grinding the bottom surface includes forming the normal to the bottom surface parallel to both the work spindle rotational axis and the tool spindle rotational axis.

18. The method of claim 17 in which the step of grinding the top surface includes forming the normal to the top surface parallel to both the work spindle rotational axis and the tool spindle rotational axis.

19. The method of claim 15 in which the steps of grinding include feeding the grinding wheel in a direction parallel to the rotational axis of the tool spindle for engaging the top and bottom surfaces of the optical flat.

20. A method of machining optical flats with wedged planar surfaces comprising the steps of:

mounting an optical flat having top and bottom surfaces on a first part-holding fixture;

rotating the first part-holding fixture about a work spindle rotational axis;

rotating a grinding wheel into engagement with the bottom surface of the optical flat about a tool spindle rotational axis;

grinding the bottom surface of an optical flat into a planar form having a planar surface normal that extends parallel to the work spindle rotational axis;

mounting the bottom planar surface of the optical flat on a second part-holding fixture in a position that orients the normal of the bottom planar surface at an inclination with respect to the work spindle rotational axis;

rotating the second part-holding fixture about the work spindle rotational axis;

rotating a grinding wheel into engagement with the top surface of the optical flat about the tool spindle rotational axis; and grinding the top surface of the optical flat into a planar form having a planar surface normal that extends parallel to the work spindle rotational axis, but is inclined with respect to the planar surface normal of the bottom planar surface, wherein the steps of mounting the bottom planar surface includes applying a pressure reduction against the bottom planar surface for holding the optical flat against the second part-holding fixture that is rotatable about the work spindle axis.

21. The method of claim 20 in which the step of mounting the bottom planar surface includes engaging the bottom planar surface with the mounting land in an orientation that inclines the normal of the bottom planar surface with respect to the work spindle rotational axis.

* * * * *